United States Patent [19]

Yoshida

[11] Patent Number: 4,480,538

[45] Date of Patent: Nov. 6, 1984

[54] MEANS FOR CORRECTING THE POSITION OF BOTTOM DEAD CENTER IN A PRESS

[75] Inventor: Akihiro Yoshida, Gifu, Japan

[73] Assignee: Kabushiki Kaisha Yamada Dobby, Bisai, Japan

[21] Appl. No.: 557,067

[22] Filed: Dec. 2, 1983

[30] Foreign Application Priority Data

Dec. 16, 1982 [JP] Japan ..... 57-222440

[51] Int. Cl.[3] ..... B30B 15/14

[52] U.S. Cl. ..... 100/48; 100/282; 100/43

[58] Field of Search ..... 100/43, 48, 282, 53; 72/21, 25; 83/72, 74, 75

[56] References Cited

U.S. PATENT DOCUMENTS

| | | | |
|---|---|---|---|
| 3,450,912 | 6/1969 | La Vallee | 100/43 X |
| 3,664,217 | 5/1972 | Schiewek | 83/72 X |
| 4,062,213 | 12/1977 | Schneider | 100/43 X |
| 4,429,627 | 2/1984 | Edso | 100/43 X |

FOREIGN PATENT DOCUMENTS 138712 11/1979 German Democratic Rep. ... 100/53

*Primary Examiner*—Billy J. Wilhite

*Attorney, Agent, or Firm*—Erwin S. Teltscher

[57] ABSTRACT

Disclosed herein is means for correcting the position of bottom dead center of a slide in a press having a frame, a crankshaft rotatably mounted on the frame, and a slide connected to the crankshaft and movable in a vertical plane, wherein the correlation between the rotational speed of the crankshaft and the bottom dead center position of the slide is determined in one-to-one correspondence. The means comprises a variable speed motor for rotating the crankshaft; a sensor for sensing the position of bottom dead center of the slide; and a control circuit for comparing the signal generated from the sensor which is representative of the bottom dead center position with a signal representative of a preset reference position of bottom dead center of the slide and controlling the speed of the motor to suit the speed representative of the reference position of bottom dead center of the slide.

5 Claims, 3 Drawing Figures

MEANS FOR CORRECTING THE POSITION OF BOTTOM DEAD CENTER IN A PRESS

BACKGROUND OF THE INVENTION

1. Field of the Invention

The present invention relates to means for correcting the position of the bottom dead center of a slide in a press.

2. Description of the Prior Art

In general, a press shows variations in the bottom dead center position of the slide, when operated at high speeds or continually for a long time. This problem is caused by the fact that when greater inertia force developed by a higher speed operation of the press is applied to the slide, clearance around the crankshaft causes variations in the bottom dead center position of the slide, in spite of balancing the weight of the slide by an air balancer and other suitable means, and that when the operation is continued for a long time, connecting parts such as the plunger connection are expanded by heat generated in the press to cause the bottom dead center of the slide to be lowered and in case the operation is further continued, the frame, especially the column is thermally expanded to cause the bottom dead center to be raised.

To correct these variations in the bottom dead center position of the slide, the prior art has proposed to employ a stopper to limit the bottom dead center position or the operation of the press itself has been stopped severally for accomplishing fine adjustment.

The former prior art, however, causes loss of efficiency of the press, and in case of precision machining, adjustment of the position of the stopper is difficult. The latter prior art has the problem of requiring troublesome work as well as substantial reduction in the working ratio of the press.

SUMMARY OF THE INVENTION

It is therefore an object of the present invention to avoid the above noted disadvantages of the prior art by providing a novel means for correcting the position of bottom dead center in a press which may automatically correct the positon of bottom dead center without losing the capacity of the press.

According to the present invention, there is provided means for correcting the position of bottom dead center of a slide in a press having a frame, a crankshaft rotatably mounted on the frame, and a slide connected to the crankshaft and movable in a vertical plane, wherein the correlation between the rotational speed of the crankshaft and the bottom dead center position of the slide is determined in one-to-one correspondence. The means comprises a variable speed motor for rotating the crankshaft; a sensor for sensing the position of bottom dead center of the slide; and a control circuit for comparing the signal generated from the sensor which is representative of the bottom dead center position with a signal representative of a preset reference position of bottom dead center of the slide and controlling the speed of the motor to suit the speed representative of the reference position of bottom dead center of the slide.

The invention will become more fully apparent from the claim and the description as it proceeds in connection with the drawings.

DETAILED DESCRIPTION OF THE PREFERRED EMBODIMENT

Before describing a preferred embodiment of the invention, a brief description will be given as to a correlation between the bottom dead center position of the slide and the rotational speed of the crankshaft.

Figure 3:
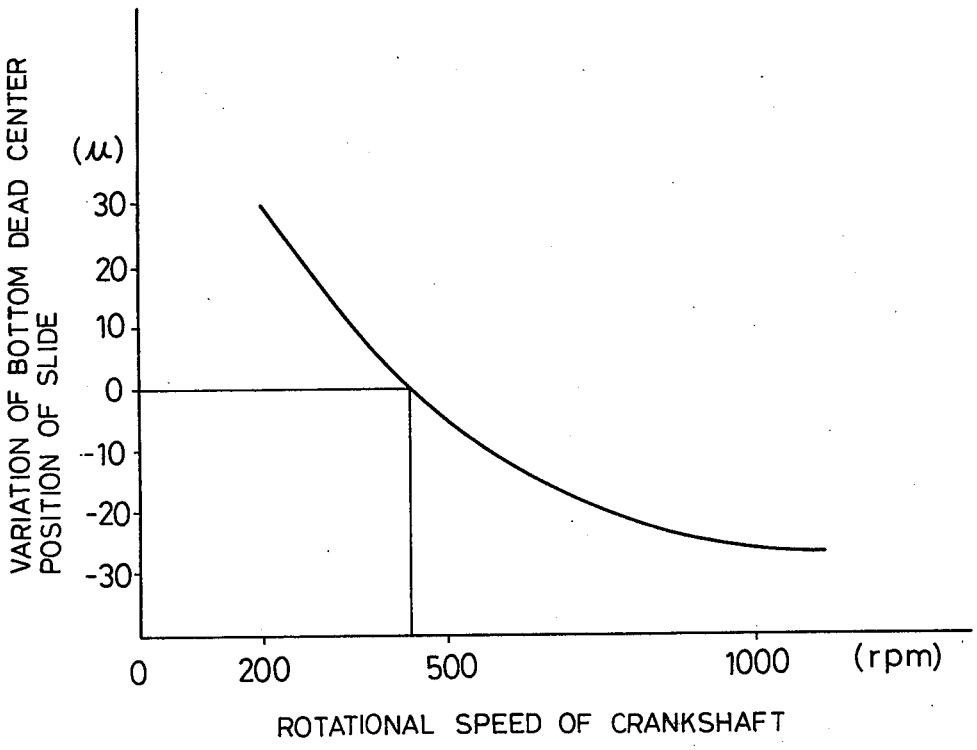
FIG. 3 is a diagram showing the correlation between the rotational speed of the crankshaft and the variation of the bottom dead center position of the slide.

The bottom dead center position of the slide 5 varies as the rotational speed of the crankshaft 7 is varied, as shown in FIG. 3. More particularly, when the rotational speed of the crankshaft 7 is 450 rpm as in FIG. 3, the bottom dead center of the slide 5 assumes its normal position; if the rotational speed of the crankshaft 7 is below 450 rpm, the bottom dead center of the slide 5 moves upwardly from its normal position, and if above 450 rpm, the bottom dead center moves downwardly. This minute variation in the bottom dead center position of the slide is caused by the variation in inertia force applied to the slide which is caused as the rotational speed of the press is varied. This fact is noted in the present invention which is proposed to correct the variation in the bottom dead center position during the operation of the press by detecting the variation in the bottom dead center position of the slide and controlling the rotational speed of the crankshaft based on the correlation between the rotational speed of the crankshaft and the bottom dead center position of the slide shown in FIG. 3.

Figure 1:
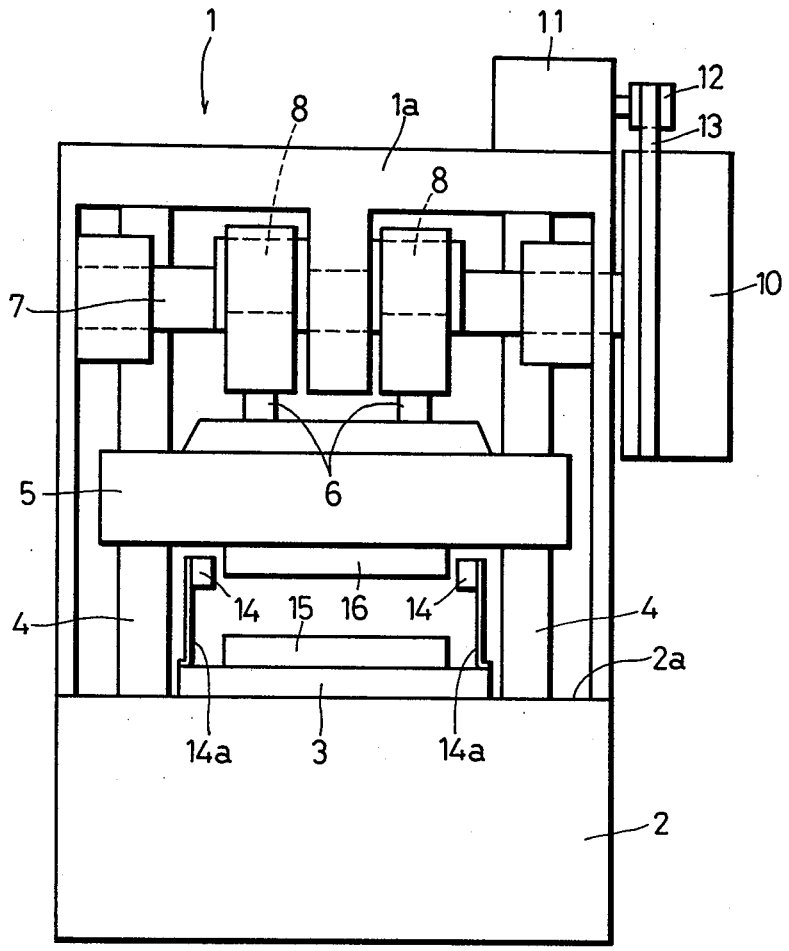
FIG. 1 is a schematic view illustrating the construction of a press incorporating a preferred embodiment of the present invention.

Referring now to FIG. 1, there is shown in a schematic form a press 1 in which a preferred embodiment of the present invention is embodied. The press 1 has a frame 1*a* and a bed 2. A bolster 3 is mounted on the horizontal upper surface 2*a* of the bed 2. Extending from the upper surface 2*a* of the bed 2 and surrounding the bolster 3 are four posts 4 which are arranged in a rectangular configuration in cross section. The posts 4 carry a slide 5 which is vertically slidable therealong. Connected to the upper surface of the slide 5 are a pair of connecting rods 6 which in turn are connected to a pair of crankpins 8 of a crankshaft 7. A flywheel 10 is carried on one end of the crankshaft 7. Mounted on the frame 1*a* is a motor 11 which has a pulley 12 on the shaft thereof. The flywheel 10 is connected to the pulley 12 through a belt 13. The motor 11 in this embodiment is an eddy-current motor having a motor body 11*a*, a coupling 11*b* and a tachogenerator 11*c*.

There are provided two sensors 14 mounted on both ends of the upper surface of the bolster 3 through brackets 14*a* and adapted for sensing the bottom dead center position of the slide 5. The sensor 14 in this embodiment is a magnetic sensor containing a coil, but a capacitance-operated sensor or ultrasonic sensor may be employed.

There are provided a lower die 15 secured to the bolster 3 and an upper die 16 secured to the slide 5 in opposed relation with the lower die 15.

Figure 2:
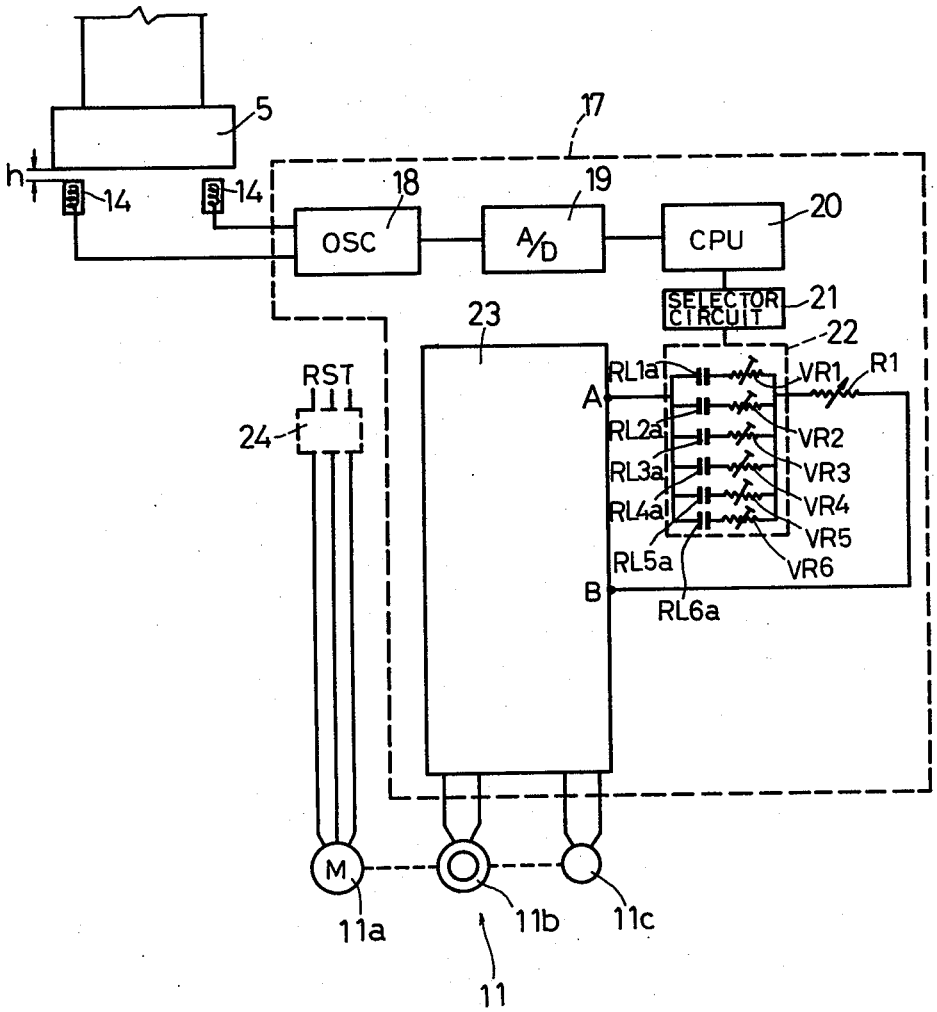
FIG. 2 is a block diagram of the control circuit.

Now, a control circuit 17 will be explained with reference to FIG. 2. The control circuit 17 is mainly composed of a detecting circuit (OSC) 18, an analog-to-digital converter 19, a CPU 20, a selector circuit 21 and a speed-setting resistor circuit 22, and a controller 23.

The detecting circuit 18 is composed of an oscillator circuit, a voltage detecting circuit and a mean value circuit which are not shown. The high-frequency output from the oscillator circuit is applied to the coils of the sensors 14, and the respective voltage generated across the coils is detected by the voltage detecting circuit. When the slide 5 approaches the sensors 14 and reaches the bottom dead center, the permeability of the coils of the sensors 14 varies in proportion to the distance h between the bottom dead center of the slide 5 and the sensers 14. This results in variation in the voltage generated across the coils to which high-frequency voltage has been applied. The varied voltages are analogously detected by the voltage detecting circuit of the detecting circuit 18. The voltages across the coils of the sensors 14 and detected by the voltage detecting circuit are inputted to the mean value circuit of the detecting circuit 18 to be averaged, and the averaged value is inputted to the converter 19.

The analog-to-digital converter 19 is adapted for converting the analog signal from the detecting circuit 18 which is indicative of the averaged distance h between the sensor 14 and the slide 5 at its bottom dead center position, into the digital form, and the digital signal thus obtained is inputted to the CPU 20.

The CPU 20 receives as an input the signal indicative of the averaged distance h from the analog-to-digital converter 19 and calculates the difference $\Delta h$ from the reference value $h_0$ preset in the CPU 20. When the difference $\Delta h$ exceeds the preset allowable value $\Delta h_0$ successively N times (N is preset suitably), the CPU 20 outputs to the selector circuit 21 a control signal proportional to the excess amount $\Delta h - \Delta h_0$ (The correlation between the excess amount and the control signal is preset in the CPU 20.)

The selector circuit 21 serves as a decorder for receiving the control signal from the CPU 20 as an input and selecting one out of speed setting resistors $VR_1$ to $VR_6$ in the speed setting resistor circuit 22 in response to the signal.

The speed setting resistor 22 is mainly composed of a plurality of speed setting resistors $VR_1$ to $VR_6$ (Semi-fixed volumes are employed in this embodiment.) each having different resistance value, relay contacts $RL_{1a}$ to $RL_{6a}$ and a main variable resistor $R_1$. The relay contacts $RL_{1a}$ to $RL_{6a}$ are normally open contacts of the relays $RL_1$ to $RL_6$ (not shown) which are energized by the control signal from the selector circuit 21. When one of the relay contacts turns on, the associated one of the speed setting resistors $VR_1$ to $VR_6$ is selected. Although six speed setting resistors $VR_1$ to $VR_6$ and six relay contacts $RL_{1a}$ to $RL_{6a}$ are employed in this embodiment, the numbers of the speed setting resistors and relay contacts may be varied as required.

Numeral 23 designates a controller known in the art and adapted for controlling the rotational speed of the motor 11 and mainly composed of a speed controller (not shown) for amplifying the deviation of the speed setting voltage set between the terminals A and B from the speed feedback voltage sent from the tachogenerator 11*c*, a thyristor module (not shown) for controlling the exciting current to the coupling 11*b*, a phase-control circuit (not shown) adapted for determining the timing of the trigger pulse for firing the thyristor module, a main circuit power module (not shown) and various protective circuits (not shown).

The controller 23 thus constructed serves to maintain the rotational speed of the motor 11 (which does not mean the rotational speed of the motor body 11*a* but that of the output shaft of the motor 11 including the motor body 11*a*, coupling 11*b* and tachogenerator 11*c*) at a predetermined value by comparing the voltage between the terminals A and B which is set by the resistance of the speed setting resistor circuit 22 with the feedback voltage generated by the tachogenerator 11*c* in proportion to the rotational speed and then automatically regulating the exciting current of the coupling 11*b* in response to the deviation therebetween. Numeral 24 designates an electromagnetic switch.

In operation, when the motor 11 is rotated, the crankshaft 7 is rotated through the pulley 12, belt 13 and flywheel 10. The slide 5 is moved vertically by the connecting rod 6 connected to the crank pin 8. In other words, the vertical movement of the slide 5 accomplishes pressing operation.

The bottom dead center of the slide 5 is sensed by the sensors 14, and thus obtained signal indicative of the distance h between the sensor 14 and the slide 5 is inputted through the detecting circuit 18 and analog-to-digital converter 19 to the CPU 20.

As explained above, the CPU 20 calculates the difference $\Delta h$ of the inputted signal from the reference value (reference distance $h_0$) preset in the CPU 20 and when the difference $\Delta h$ exceeds the preset allowable value $\Delta h_0$ successively N times (N is set suitably.), a specified control signal proportional to the excess amount $\Delta h - \Delta h_0$ is outputted to the selector circuit 21. Then, the selector circuit 21 energizes a specified relay (not shown) responsive to the control signal. (The correlation therebetween is preset.) When, for example, the relay $R_1$ is energized, the normally open contact $RL_{1a}$ thereof turns on and the speed setting resistor $VR_1$ is selected. As the result, the voltage generated by the speed setting resistor $VR_1$ and the main variable resistor $R_1$ is applied between the terminals A and B of the controller 23. The voltage for setting the speed of the motor 11 is obtained in this way, and the motor 11 is controlled to the predetermined speed in response to the speed setting voltage.

In this embodiment, the sensors 14 are employed to sense the variation in the position of the bottom dead center of the slide 5, and when the variation or the error of the position of the bottom dead center of the slide 5 exceeds an allowable value successively N times, the rotational speed of the motor 11 is controlled to correct the rotational speed of the crankshaft 7 and then the error of the bottom dead center position of the slide 5. Thus, correction of the bottom dead center position of the slide can be automatically accomplished during the operation of the press.

While the invention has been described with reference to a preferred embodiment, it is to be understood that further modifications and variations may be made. For example, instead of the coupling 11*b* used to control the rotational speed of the motor 11 in this embodiment, an inverter or pole changing controller may be employed.

What is claimed is:

1. For use in a press having a frame, a crankshaft rotatably mounted on said frame, and a slide connected to said crankshaft and movable in a vertical plane, wherein the correlation between the rotational speed of said crankshaft and the bottom dead center position of said slide is determined in one-to-one correspondence, means for correcting the position of bottom dead center of said slide comprising:

a variable speed motor for rotating said crankshaft;

a sensor for sensing the position of bottom dead center of said slide; and a control circuit for comparing the signal generated from said sensor which is representative of said bottom dead center position with a signal representative of a preset reference position of bottom dead center of said slide and controlling the speed of said motor to suit a speed representative of said reference position of bottom dead center of said slide.

2. The means as defined in claim 1 wherein said motor comprises a motor body, a coupling, and a tachogenerator.

3. The means as defined in claim 1 wherein said sensor is of a coil type.

4. The means as defined in claim 1 wherein said control circuit comprises:

a detector circuit for analogously detecting said signal from said sensor;

an analog-to-digital converter for converting the analog signal generated from said detector circuit to a digital form;

a CPU for calculating the difference between the input signal from said analog-to-digital converter and the signal representative of a preset reference position of bottom dead center of said slide and generating a control signal proportional to the excess amount represented when said difference exceeds the preset allowable value succesively a predetermined number of times;

a selector circuit for decoding the signal from said CPU;

a speed setting resistor circuit including a plurality of speed setting resistors each with a different resistance value and selecting one of said speed setting resistors which is representative of said signal from said selector circuit; and a controller for controlling the speed of said motor in accordance with said signal from said speed setting resistor circuit so as to suit the rotational speed representative of said reference position of bottom dead center of said slide.

5. The means as defined in claim 4 wherein said speed setting resistor circuit includes a plurality of relay contacts each connected to each of said speed setting resistors and a main variable resistor connected all of said speed setting resistors.

* * * * *